US005931347A

United States Patent [19]

Haubrich

[11] Patent Number: 5,931,347

[45] Date of Patent: Aug. 3, 1999

[54] DISPENSER UNIT FOR VISCOUS SUBSTANCES

[76] Inventor: Mark A. Haubrich, 35584 C-44, Le Mars, Iowa 51031

[21] Appl. No.: 08/862,652

[22] Filed: May 23, 1997

[51] Int. Cl.[6] ..... B67D 5/56

[52] U.S. Cl. ..... 222/129; 222/327; 222/386; 604/191

[58] Field of Search ..... 222/129, 325, 222/326, 327, 386; 604/191

[56] References Cited

U.S. PATENT DOCUMENTS

| | | | |
|---|---|---|---|
| 530,187 | 12/1894 | Laskey . | |
| 2,309,446 | 1/1943 | Ekkebus | 222/386 |
| 2,887,253 | 5/1959 | Biedenstein | 222/327 |
| 3,016,897 | 1/1962 | Kendrick | 128/218 |
| 4,264,020 | 4/1981 | Loiseau | 222/207 |
| 4,403,989 | 9/1983 | Christensen et al. | 604/137 |
| 4,487,602 | 12/1984 | Christensen et al. | 604/137 |
| 4,642,099 | 2/1987 | Phillips et al. | 604/136 |
| 4,651,904 | 3/1987 | Schuckmann | 222/383 |
| 4,676,781 | 6/1987 | Phillips et al. | 604/135 |
| 4,717,383 | 1/1988 | Phillips et al. | 604/135 |
| 4,804,023 | 2/1989 | Frearson | 141/65 |
| 4,813,870 | 3/1989 | Pitzen | 433/90 |
| 4,830,227 | 5/1989 | Ball et al. | 222/207 |
| 4,892,231 | 1/1990 | Ball | 222/207 |
| 4,946,077 | 8/1990 | Olsen | 222/256 |
| 5,141,496 | 8/1992 | Dalto | 604/117 |
| 5,217,147 | 6/1993 | Kaufman | 222/185 |
| 5,275,214 | 1/1994 | Rehberger | 141/65 |
| 5,385,081 | 1/1995 | Sneddon | 222/386 |
| 5,450,924 | 9/1995 | Tseng | 184/1.5 |
| 5,482,187 | 1/1996 | Poulsen et al. | 222/207 |
| 5,492,247 | 2/1996 | Shu et al. | 222/63 |
| 5,492,252 | 2/1996 | Gueret | 222/207 |

FOREIGN PATENT DOCUMENTS

| | | | |
|---|---|---|---|
| 229367 | 2/1925 | United Kingdom | 222/327 |

OTHER PUBLICATIONS

Copy—1 page (p. 3) from an Ideal Instruments Product Catalog 1993 entitled "Hypodermic Syringes & Needles".

Copy—1 page (p. 9) from a Jorgensen Laboratories, Inc. 1994 Product Catalog entitled "Syringes and Hypodermic Needles II".

*Primary Examiner*—Joseph A. Kaufman

*Attorney, Agent, or Firm*—Henderson & Sturm

[57] ABSTRACT

A reducible-volume cartridge for holding a viscous substance for use in combination with a dispenser of a pump-type utilizing a sub-atmosphere pressure to effect withdrawal of a predetermined amount of the substance from the cartridge for ejection through the dispenser, the cartridge having a hollow, annular body with identical ends, and a floating piston disposed for axial movement in a sealing manner within the cartridge thus forming a reducible chamber within the cartridge, the chamber holding the viscous substance on the side of the piston facing the dispenser, with the opposite side open to the atmosphere; the cartridge optionally having a wall formed midpoint its length to form a pair of chambers, with a pair of pistons disposed for axial movement, each within a chamber and each initially disposed adjacent the wall, the body and wall of the optional cartridge having a passage formed therein to expose each chamber to the atmosphere; either cartridge usable with the dispenser to discharge the substance from one chamber, then removable, rotatable to attach an opposite end to the dispenser, and re-usable to discharge substance from a refilled chamber, or from a second chamber.

30 Claims, 6 Drawing Sheets

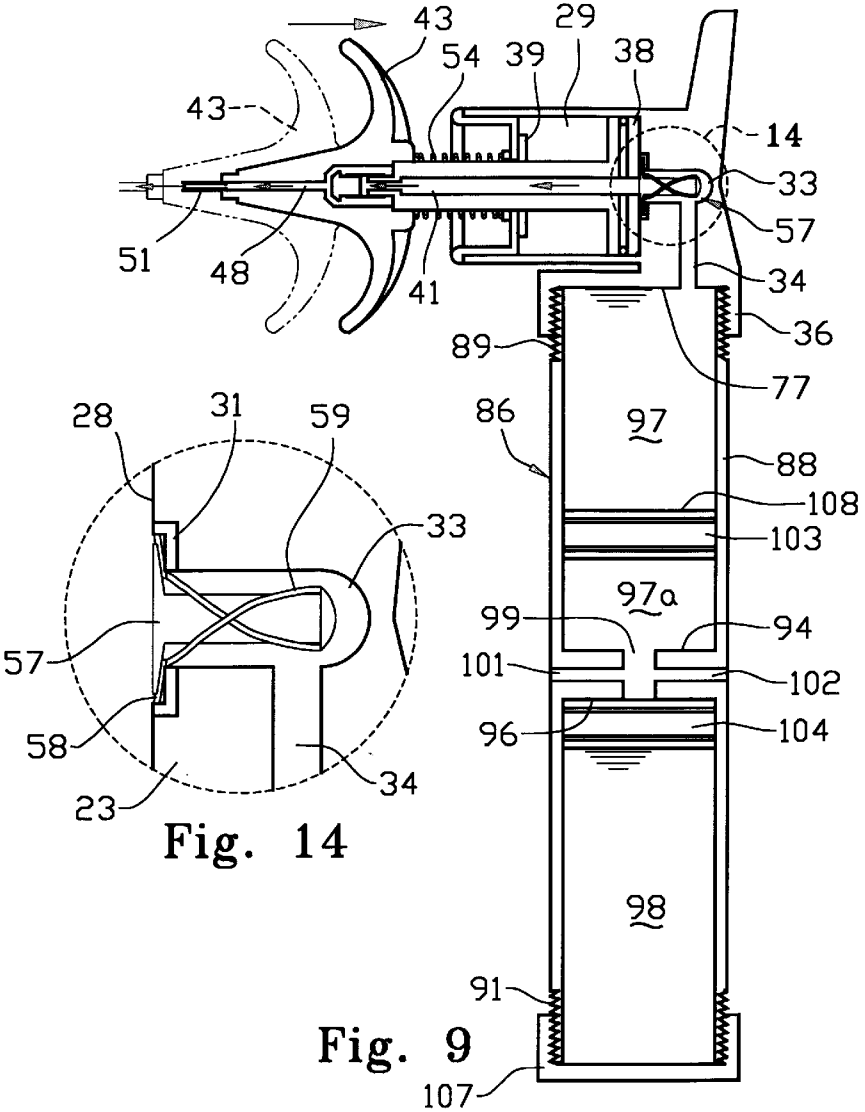
Fig. 9
Fig. 14
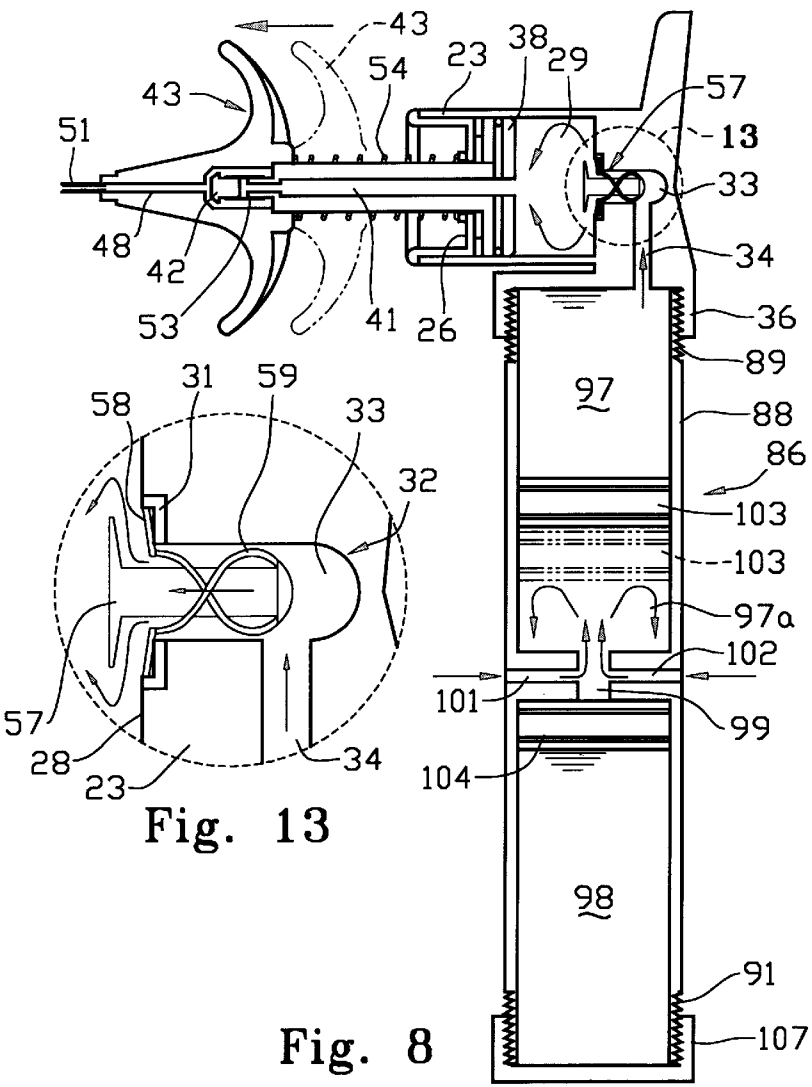
Fig. 13
Fig. 8

DISPENSER UNIT FOR VISCOUS SUBSTANCES

CROSS-REFERENCE TO RELATED APPLICATIONS

Not applicable

STATEMENT REGARDING FEDERALLY SPONSORED RESEARCH OR DEVELOPMENT

Not applicable.

MICROFICHE APPENDIX

Not applicable.

BACKGROUND OF THE INVENTION

This invention relates to a reducible-volume cartridge for holding a viscous substance for use in combination with a dispenser of a pump-type utilizing a vacuum or sub-atmospheric pressure to effect withdrawal of a predetermined amount of the substance from the cartridge for ejection through the dispenser.

One pump-type dispenser relates to syringes for injecting humans or animals with fluids such as serums, vaccines, virus and the like via needles attached to the dispenser. One type is commonly called a pistol grip syringe. This type of syringe fits comfortably in the hand, however, when fully loaded, the syringe is over 16" long, which makes it very user unfriendly when vaccinating animals in tight quarters, such as individual crates or in chutes. If the animal thrashes around, the syringe can get caught up in the bars of the crates or chute and not allow the operator to get his hand out quickly. Refilling the pistol grip syringe is done by inverting the serum bottle, piercing the rubber stopper with the needle on the syringe, and pulling back on the plunger. This causes a vacuum in the syringe tube, thus filling it. Problems with this type syringe dispenser, are that one must hold the bottle and front end of the syringe (needle end) with one hand and pull back the plunger with the other; also, clearing air out of the syringe causes some serum to be expelled as well, which in turn runs down over the syringe, making it very slippery and hard to hold onto. Further, the smaller the needle the harder it becomes to pull the plunger back and bring serum into the syringe. The smaller needle restricts the flow, making the vacuum much more powerful, which in turn fatigues the operator and increases the time it takes to fill the syringe.

When one is hanging onto the needle end during filling and pulling hard on the other end, it is easy to see that one is very prone to a needle stick. Another disadvantage, is that when using this type of syringe with multi-dose vials, the rubber stopper in the vial becomes so perforated with holes that when you invert the bottle, the serum starts to drip out and it is hard to get the needle sealed to enable the vacuum to be formed. Also, bits of the rubber stopper flake off into the needle, which can plug the needle or could be injected into the animal magnifying the possibility of an abscess and/or infection. Every time one uses multi-dose vials, the entire contents of the vial are contaminated every time the pistol grip syringe is refilled. Further, pistol grip syringes are limited to a maximum of 50 cc's of serum within their bodies, which means the problems with refilling are faced repeatedly. Once the syringe is full of serum, one must continually clear the air from the syringe, resulting in serum waste.

Another type of syringe is the "bottle draw off" syringe. This syringe has a mounting surface to hold a bottle in an inverted position. In the center of the mounting surface is a stationary hollow spike which communicates serum with the ejection barrel. Problems with this type of syringe are: every time one pushes the bottle down over the stationary spike, small pieces of rubber flake off and start to restrict the flow of serum, and can eventually completely block the flow of serum. This problem can result in an inadequate does of serum delivered to the animal. When vaccinating with this syringe type, the quick forward movements of the operator will foam the serum making delivery inadequate.

The downward angle that is required for vaccinating, coupled with quick movements can slosh the liquid up to one side of the bottle and away from the hollow spike, resulting in an inadequate amount of serum delivered to the animal. Also, when using multi-dose vials with this syringe, it is easy to see that repeatedly puncturing the rubber stopper with the hollow spike and leaving the vial inverted drastically increases the amount of leakage.

A third type of injecting syringe dispenser is a reservoir draw-off syringe. This syringe has no reservoir of its own but has a long tube hooked to its plunger, and the opposite end is hooked to a reservoir somewhere on the operator's body. This reservoir is usually inverted and carried around the neck, shoulder, or in a pocket. The problems with this type of syringe include: it cannot be used efficiently for smaller vaccinating tasks because the tube alone can only hold 10 ml of serum; it takes much priming to get serum from reservoir out to the end of operator's hand, causing operator fatigue; and the long tube can easily be caught and disconnected from reservoir by surrounding equipment or can be disconnected by surrounding animals.

This syringe suffers some of the same problems as the "bottle draw-off" syringe in that foaming will occur, caused by the quick movements of the operator; and the liquid sloshing away from the exit port will cause air bubbles throughout the entire line and syringe, resulting in inadequate serum being delivered.

Another pump-type dispenser relates to a cartridge of a solid or flexible nature for dispensing a pasty substance, such as toothpaste, lotion, liquid soap and the like through a permanent dispenser normally mounted on the top of the cartridge and utilizing a thumb-pressure dispenser. The main disadvantages of this type of dispenser are the complexity of the pump-dispenser mechanism and the non-re-usability of the cartridge, most if not all being of a disposable nature.

To a solution of these types of problems and disadvantages of the pump-type viscous substancy dispensers of the prior art, this invention is directed.

BRIEF SUMMARY OF THE INVENTION

The present invention provides as one example of a generic vacuum-type dispenser a hand-operated pistol of the pump-action type which has a chamber fluid connected through a needle at one end of the dispenser to an open receptacle, via a valved-passage, and with a piston reciprocally and manually movable within the chamber to effect a vacuum or sub-atmospheric pressure condition within the passage.

The reducible-volume cartridge is provided by two embodiments, one a single chamber and the other a double chamber. The single chamber cartridge has an annular shape, although any shape is usable, but with an annular interior for accommodating an annular piston which is sealingly and reciprocally mounted within the chamber for axial movement from one end of the chamber to the other, and back again. The opposite ends of the cartridge are open and identical such that one end can be sealingly fitted with the open receptacle then removed, the cartridge reversed, and then the other end sealingly fitted with the receptacle.

Prior to use, a viscous substance can be filled into the cartridge, with the piston located at one end of the cartridge such as to form a bottom to the cartridge, although a cap could be placed over the bottom, the cap having an opening formed therein for providing access to the base of the piston for atmospheric air pressure. As action of the dispenser causes a dosage-type withdrawal of the substance from the open end of the cartridge adjacent the passage, the piston follows the substance withdrawal, moving toward the open end and maintaining a positive pressure upon the substance remaining within the cartridge.

When the piston "bottoms-out" within the receptacle such that no substance remains, the cartridge is removed from the receptacle, reversed such that the piston is again at the bottom of the cartridge, the cartridge is refilled with the substance and the reversed open end of the cartridge is sealingly fitted to the dispenser receptacle. The cartridge is re-usable many times in this manner.

The double chamber cartridge also has open opposite ends both of which can be sealingly fitted to the receptacle open end, and has a wall midpoint the length of the cartridge, with the wall open to the atmosphere by passages, and with the passages leading to each chamber on opposite sides of the wall. A piston is initially sealingly and axially movably positioned within each chamber contiguous each side or face of the wall, such that a pair of pistons are adjacent both sides or faces of the wall. A viscous substance can then be filled into each chamber from each piston to the opposite open end of each chamber.

Prior to usage, as with the single chamber cartridge, foil can be sealed over each open end. At usage, with the foil removed at one end and that end affixed to the receptacle, the substance within that chamber is withdrawn and ejected from the dispenser. The cartridge is then removed, reciprocated as before, the foil removed and the opposite end then affixed to the receptacle. The second chamber substance can be of a different nature from that of the first chamber substance. Prior to re-use of both chambers, the pistons need to be repositioned, such that each are placed adjacent the wall prior to refilling. If foil or a cap is used for an open end of the cartridge, a vent to atmosphere is unnecessary in view of the vent into each chamber via the wall openings.

Other types of dispensers can be used in place of the pump-action type shown herein; the requirement being a receptacle capable of receiving the cartridge in a sealed manner, and with a vacuum effected within the dispenser which vacuum is exposed to the open end of the cartridge chamber adjacent the receptacle whereby to withdraw the viscous substance from the cartridge chamber into the dispenser for discharge therefrom.

Several readily apparent advantages of the present invention are as follows: the dispenser is of a less complicated nature; the cartridges are reusable and provide for greater capacity and complete usage of all of the substance within each cartridge chamber; the wide mouth of the cartridge facilitates easy filling; and there is no need to enter the syringe-type needle into multi-dose vials, thus reducing accidental needle sticks into the operator, eliminating contamination of vial contents by a used syringe needle eliminating clearing of air through the needle, thus reducing serum waste and reducing the amount of time required to vaccinate.

Other advantages include the elimination of plugging of the needle by pieces of rubber or other debris, which pieces from time-to-time are inserted into the skin, enhancing the possibility of abscesses; eliminating foaming of the cartridge contents by the free floating piston always maintaining a positive pressure on the cartridge contents, and the capability of a cartridge which can carry two different substances at the same time, either substance readily available by merely reversing or turning the cartridge upside down.

Lastly, the new and novel dispenser unit disclosed herein eliminates the need of long tubes and bottles or other containers connected thereto and their attendant disadvantages.

BRIEF DESCRIPTION OF THE SEVERAL VIEWS OF THE DRAWING

Other objects, advantages, and novel features of the present invention will become apparent from the following detailed description of the invention when considered in conjunction with the accompanying drawings, wherein:

FIGS. 8 and 9 are partial schematic/sectional views of the unit of FIG. 7, showing changed position of various parts by the use of dash lines;

FIGS. 13 and 14 are enlarged, detailed drawings of structure identified by FIG. numerals 13 and 14 and FIGS. 8 and 9, respectively.

DETAILED DESCRIPTION OF THE INVENTION

Figure 1:
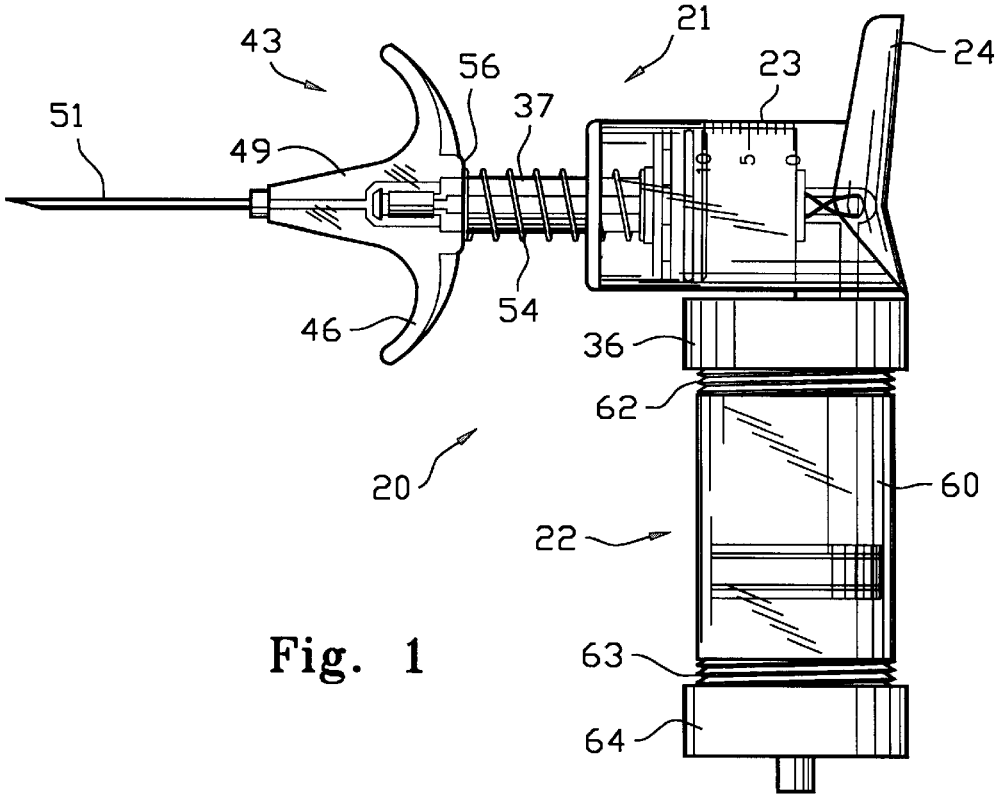
FIG. 1 shows a viscous substance dispenser unit in accordance with the invention, showing a single chamber cartridge.

Referring now to the drawings, particularly FIGS. 1–5F, 11, 12, 13 and 14, the dispenser unit of this invention is referred to generally at (20) , and comprises a dispenser (21) and a single chamber cartridge (22).

Figure 2:
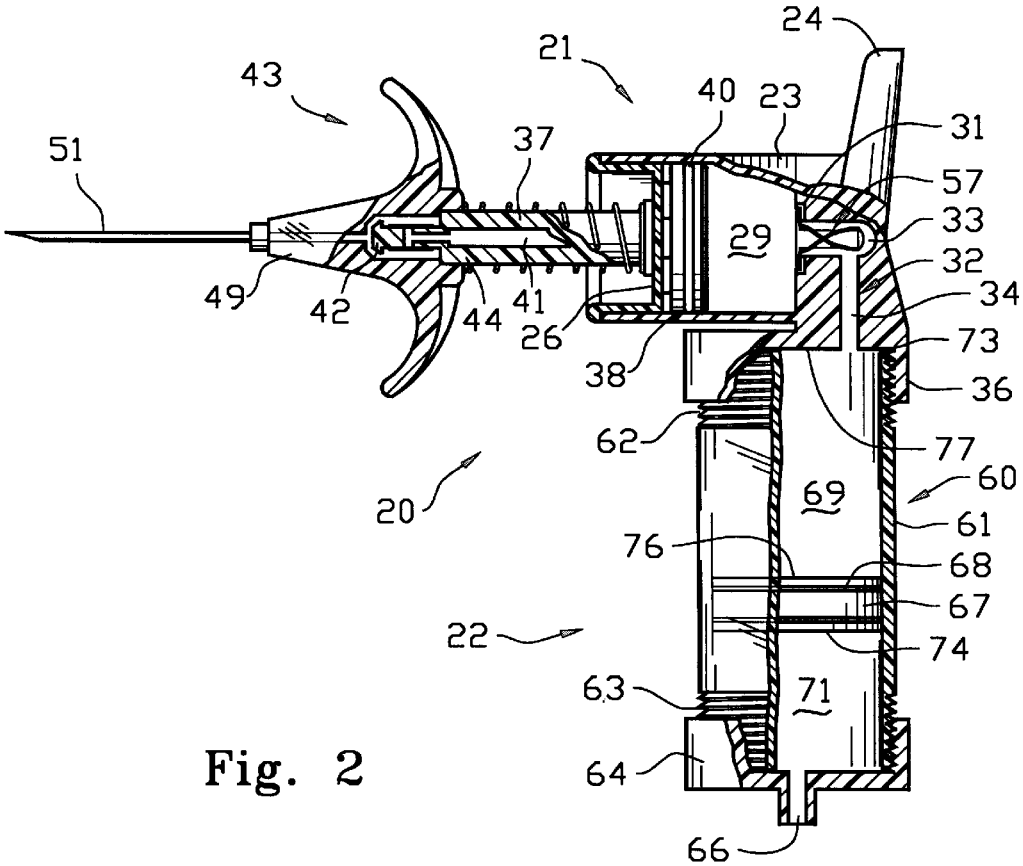
FIG. 2 shows the unit in section, with certain parts broken away for clarity of illustration.

The dispenser (21) is a conventional vacuum type having a housing (23) with a palm grip (24), with a cup-shaped non-integral forward wall (26) having a central aperture (27) (FIG. 3) formed therein; having further a rear wall surface (28) forming thereby a chamber (29) with the forward wall (26), and with a valve seat (31) formed in the face of the rear wall. The wall (26) has a friction fit into the open face of the housing (23) (FIG. 2). A passage (32) is formed in the housing (23) with a first portion (33) open to the valve seat (31) and the chamber (29), and a second portion (34) open to an open annular receptacle (36), which receptacle is internally threaded.

An elongated plunger (37) is slidable through the forward wall aperture (27) axially of the chamber (29), and with an integral piston (38), having an O-ring (40), at the rear of the plunger (37); the piston (38) sealingly, slidably mounted within the chamber (29) for movement between the rear wall surface (28) and a shoulder (39) (FIG. 4) formed on the inner face of the wall (26). An internal passage (41) is formed axially within the plunger (37) and piston (38), which passage (41) extends from the rear side of the piston (38), to communicate with the chamber (29), to a reduced plunger head (42) (FIG. 11).

A finger grip trigger (43) having a T-shape, is secured by a friction fit to a forward portion (44) (FIG. 2) of the plunger (37), is provided with finger grips (46) and has further an enlarged cavity (47) (FIG. 11) for receiving the plunger head (42), which cavity (47) communicates with a passage (48) formed in the nose (49) (FIG. 4) of the trigger (43). A needle (51) can optionally be secured to the nose (49) for passing a fluid substance from the cavity (47) and passage (48) outwardly of the needle (51). A pair of ports (52) are formed within the head (42) at opposed, normal angles to and in fluid communication with the plunger passage (41). The exposed ends of the ports (52) communicate with the cavity (47), and which plunger head (42) is encircled by a resilient—latex, for example, sleeve (53) and which sleeve (53) covers over the exposed ends of the ports (52) so as to close off the ports (52) normally from the cavity (47) (FIG. 11).

Figures 3, 4, 11, 12:
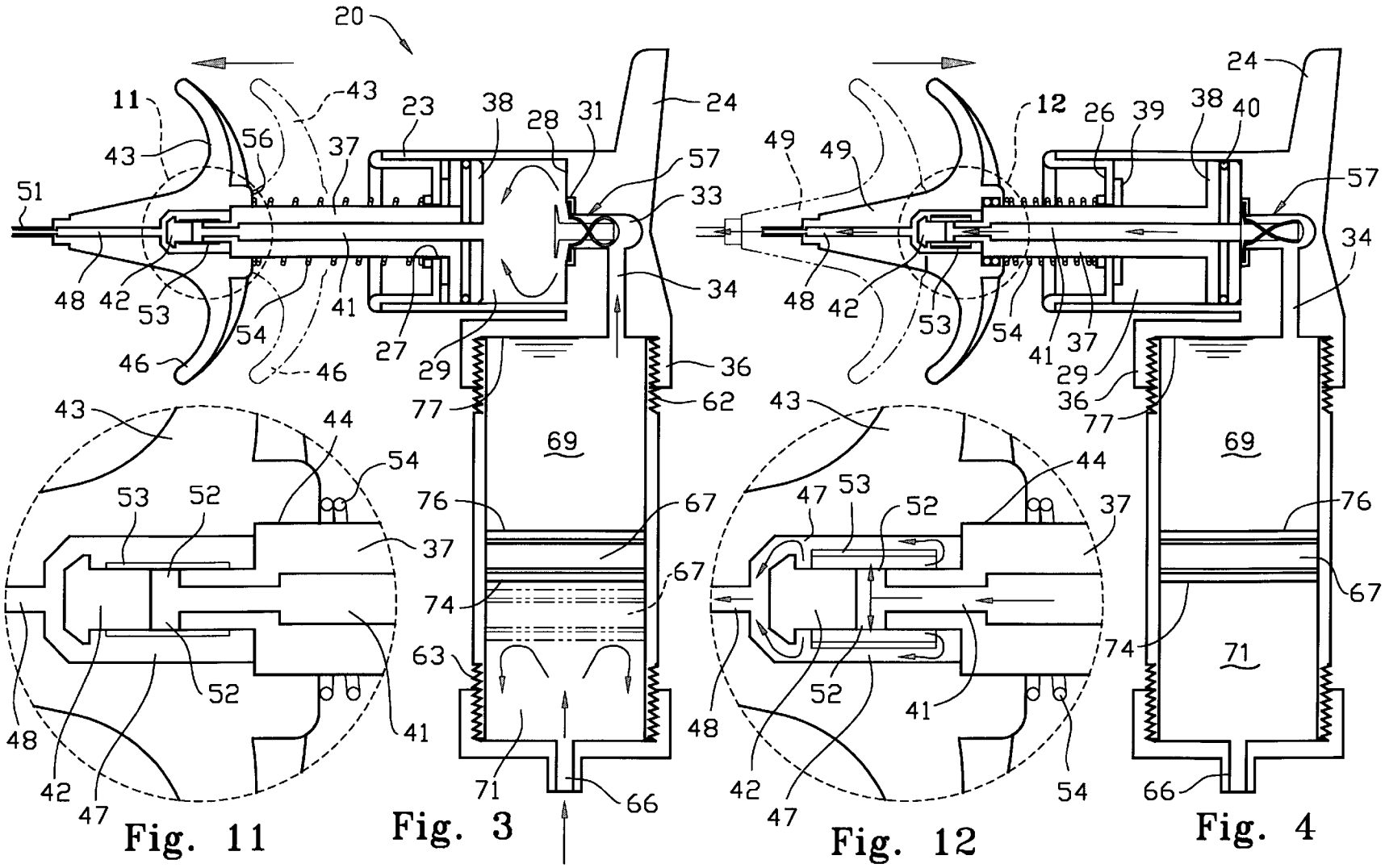
FIGS. 3 and 4 are partial schematic/sectional views of the unit of FIG. 2, showing changed positions of various parts by the use of dash lines.
FIGS. 11 and 12 are detailed schematic sectional views from FIGS. 3 and 4 showing operation of a latex sleeve as a valve.

The piston (38) is reciprocally and axially movable within the chamber (29) by biasing action of a spring (54) encircling the plunger (37) between the housing forward wall (26) and a rear surface (56) of the trigger (43), which biasing action pulls the piston (38) forwardly within the chamber (29), or from right to left as viewed in FIGS. 3 and 4.

By grasping the housing (23) with the hand, palm on the grip (24) and fingers on the trigger grips (46), the trigger (43) can be moved rearwardly against the bias of the spring (54), as shown in FIG. 4. The piston (38) then bottoms against the rear wall surface (28), and flat against a one-way valve (57) (FIG. 14) extended within the passage portion (33), the flat valve head (58) of which is frictionally seated in the valve seat (31). The valve (57) is biased to a closed position within the seat (31) by action of a spring portion (59) of the valve (57).

Conventionally, an initial pumping action of the trigger (43) effects a vacuum within the chamber (29), air unable to enter due to the needle (51) and the nose passage (48) cut off from the atmosphere by the sleeve (53), such that forward or right to left (FIG. 3) movement of the piston (38) pulls the viscous substance from the cartridge (22) into the passage (32), past the now-open valve (57) and into the chamber (29). A return of the piston (38) from left to right in the chamber (29) (FIG. 4) by finger pressure on the trigger (43), with the valve (57) biased closed, will then effect an ejection of the viscous substance from the chamber (29) through the plunger passage (41), outwardly of the ports (52) and into the cavity (47), the pressure of the substance forcing the sleeve (53) away from the ports (52) (FIG. 12), and outwardly of the cavity (47) through the nose passage (48) and the needle (51) for ejection. Upon release of the trigger (43), the trigger (43), plunger (37) and piston (38) are returned to their FIG. 3 position, the vacuum created within the chamber (29) pulling another predetermined charge of substance from the cartridge (22) into the chamber (29) for the next discharge.

Thus, in effect, a dispenser (21) is provided having a housing (23) including an open receptacle (36) at one end adapted to be sealingly connected to an open end of a cartridge (22) filled with a viscous substance, the housing (23) having a valved passage (32), (29), (41), (47) and (52) open at one end to the atmosphere, and with a member (38) movably mounted within the passage to effect a vacuum for withdrawing substance from the cartridge (23) and into the passage, and to effect a discharge of the substance outwardly from the passage.

The dispenser housing (23) and trigger (43) are primarily made of molded synthetic resin material or the like, with the chamber (29) walls transparent and showing dosage calibration markings. The length of stroke of the piston (38) can be factory set, or can be set by the operator on a multiple dosage syringe (not shown).

The single chamber cartridge (22) is best shown in FIG. 2 and comprises an elongated, hollow annular body (60) made of a molded synthetic resin material or the like, preferably transparent and of a wall (61) thickness sufficient to prevent deformation by handling or the application of a vacuum or sub-atmospheric pressure thereto. The body (60) has identical opposite, upper and lower open ends (62), (63), respectively, each end having external threads formed thereon for threaded engagement within the receptacle (36). An internally threaded cap (64) of a size similar to the receptacle (36) can be optionally provided for engagement with the lower end (63), the cap (64), having a passage (66) formed therein for communicating the interior of the cartridge (22) with the atmosphere.

A rod-less piston (67) is inserted within the cartridge (22), one or more O-rings (68) embracing the piston (67) such that the piston can move axially from one end (62) of the cartridge (22) to the other (63), and vice-versa in an axial manner. The piston (67) forms thereby an upper chamber (69) and a lower chamber (71) on opposite sides of the piston (67) within the cartridge (22).

Figure 5A:
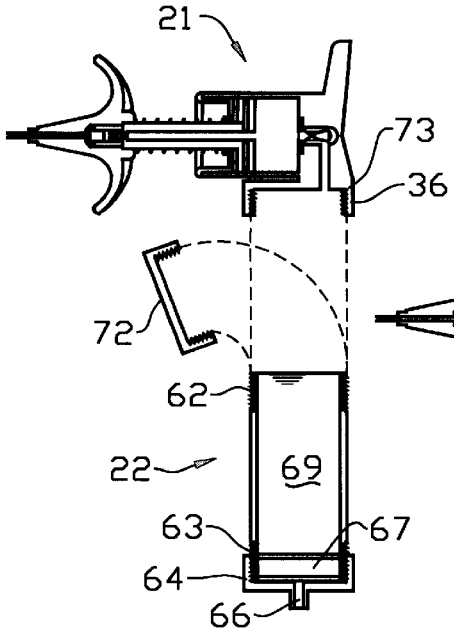
FIGS. 5A through 5F are reduced, schematic views showing sequential use and operational steps of the unit.
Figure 5B:
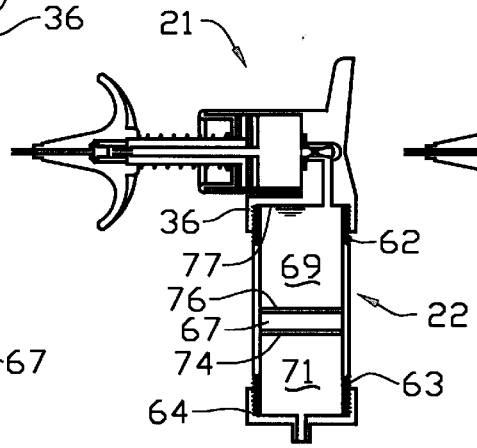
Figure 5C:
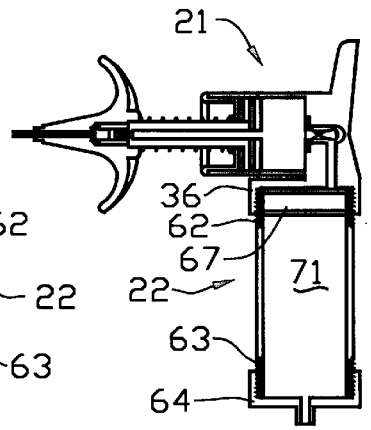
Figure 5D:
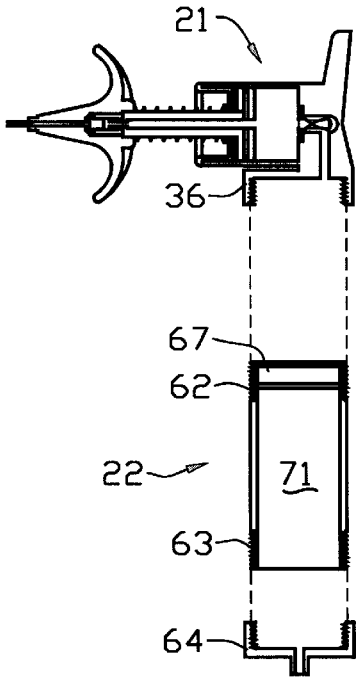
Figure 5E:
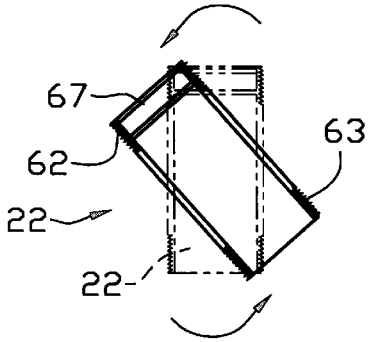

In use, the cartridge (22) may have the piston (67) positioned at the lower end (63), with the otherwise open end sealed by foil, not shown, or the cap (64) having the passage (66) covered to prevent contamination. With the lower chamber (71) at a zero capacity or volume, the upper chamber (69) may be pre-filled to the top (62) with a viscous substance, and sealed as the lower end (63), or it may be filled by the operator at the time of use. A top sealing cap (72) may be removed, an O-ring (73) inserted into the inner recess of the receptacle (36) and the open upper cartridge end (62) sealingly threaded into the receptacle (36). Pumping action of the dispenser (21) as described hereinbefore results in withdrawal of the substance from the cartridge upper chamber (69) and discharge of the substance by the dispenser, the floating piston (67) moving upwardly within the cartridge (22) due to the withdrawal of the substance and the positive atmospheric pressure on its flat underside (74), until the flat upper side (76) of the piston (67) engages and mates with the flat inner wall surface (77) FIG. 2 of the receptacle (FIGS. 5B and 5C).

Figure 5F:
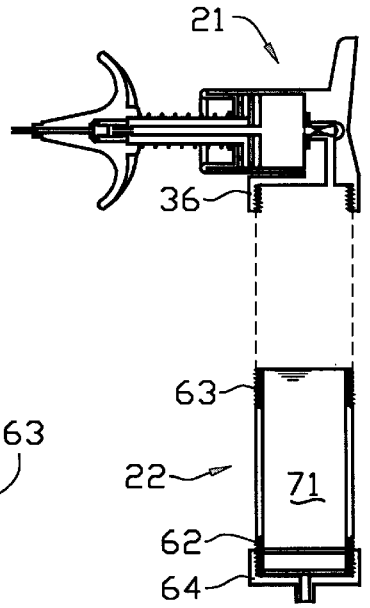

For continued use of the cartridge (22), it is removed from the receptacle (36) (FIG. 5D) the lower cap (64) removed, and the cartridge (22) rotated or turned upside down (FIG. 5E), and the cap (64) replaced on the end (62) (FIG. 5F). It is now seen that the originally lower chamber (71) can now be completely filled with the viscous substance or another as the case may be, with the now upper end (63) sealingly fitted to the receptacle (36) and the operational withdrawal and discharge steps of FIGS. 5B, 5C repeated. Further, continued removal of the cartridge (22) from the receptacle (36), reversing, refilling, re-attachment and re-use can be accomplished as described.

Figure 6:
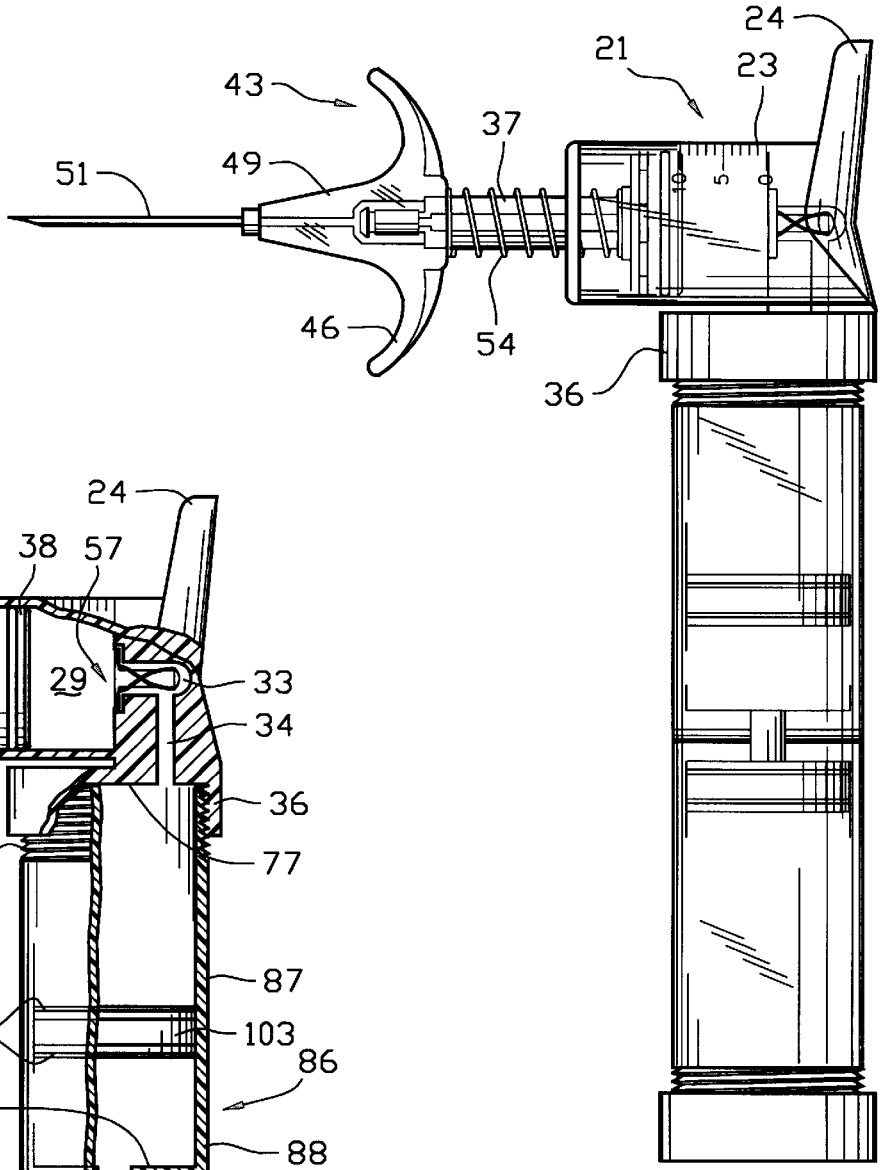
FIG. 6 is an alternate embodiment of the unit, showing a double chamber cartridge.
Figure 7:
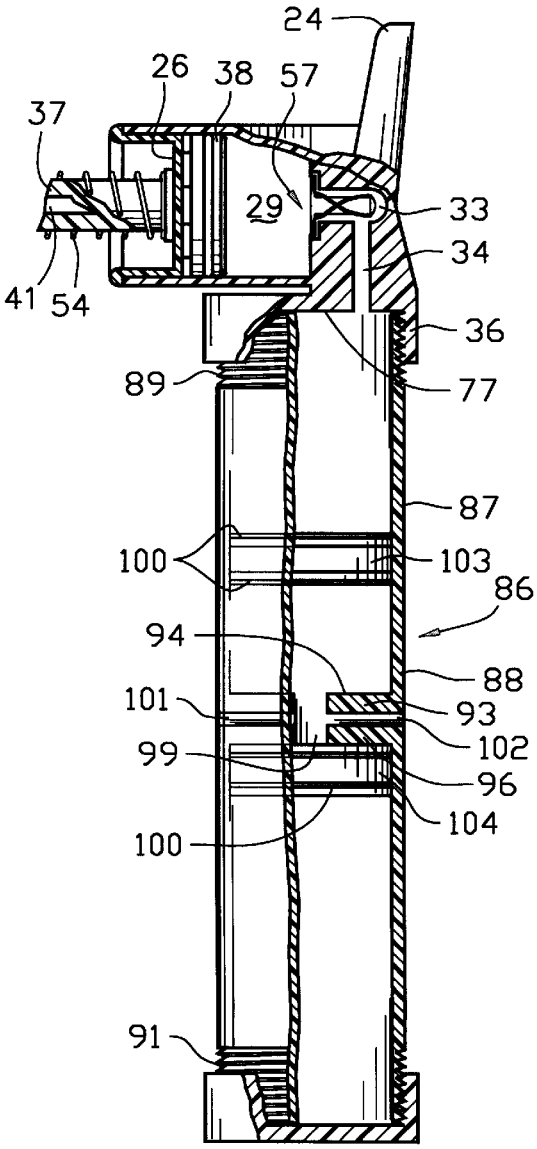
FIG. 7 shows the unit of FIG. 6 in section, fragmentary, with certain parts broken away for clarity of illustration.

The dual chamber cartridge (86) of FIGS. 6-1 OF comprises an elongated, hollow annular body (87) made of a molded synthetic resin material or the like, preferably transparent and the wall (88) of which has a thickness sufficient to prevent deformation by handling or by the application of a vacuum or sub-atmospheric pressure thereto. The body (87) has identical, opposite, upper and lower ends (89), (91), respectively, each end having external threads formed thereon for threaded engagement within the receptacle (36).

Midpoint the length of the cartridge (86), a wall (93) is formed within the interior of the cartridge (86) extended transversely thereof, and with upper and lower flat surfaces (94), (96) formed respectively on opposite sides of the wall (93). The wall surface (94) faces into an upper or first chamber (97), and the wall surface (96), faces downwardly into a lower or second chamber (98), the chambers (97), (98) formed by the wall (93) disposed therebetween.

To communicate the chambers (97), (98) with the atmosphere, an axial opening (99) is formed within the wall (83), communicating with a pair of ports (101), (102) formed transversely within the wall (93), with their outer ends exposed to the atmosphere (FIG. 8). Within each chamber (97), (98), a rod-less piston (103), (104), respectively, is disposed, each piston (103), (104) sized to sealingly and reciprocally move axially within its respective chamber. The upper end and lower surfaces of the pistons (103), (104) are also flat. One or more O-rings (100) surround each piston (103), (104) to provide for each piston (103), (104) moving axially in a sealed manner within each respective chamber (97), (98).

Figure 10A:
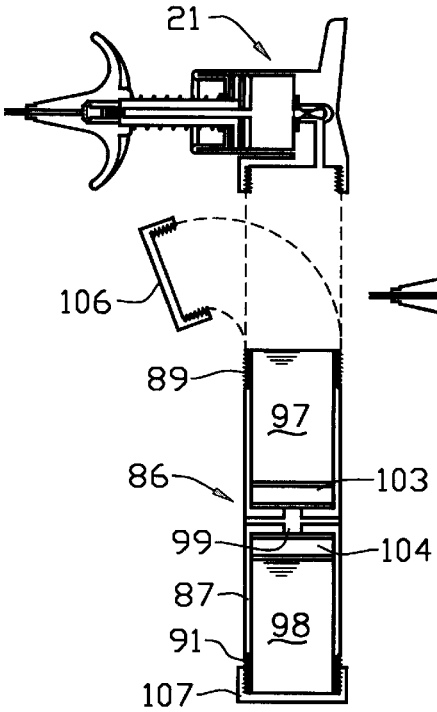
FIGS. 10A through 10F are reduced, schematic views showing sequential use and operational steps of the unit.

Prior to use, the pistons (103), (104) are initially positioned against or contiguous to their respective wall surfaces (94), (96) (FIG. 10A) and the chambers (97) and (98) are each filled with a viscous substance which could be the same in each chamber or different. The upper and lower ends (89), (91) may be sealed with a foil, not shown, easily removable by the operator at any predetermined time, or by upper and lower caps (106), (107), respectively (FIG. 10A). As shown in FIGS. 8 and 9, pumping action of the dispenser trigger (43) effects first a vacuum within the chamber (29), with the valve (57) open and the plunger valve sleeve (53) closed, to draw substance from the upper chamber (97) into the dispenser (21) for discharge therefrom, the upper chamber piston (103) following the withdrawal of a predetermined passage of substance from the diminished chamber (97) in a positive manner due to the entry of atmospheric air into the sub-chamber (97*a*) (FIG. 9) formed below the piston (103) and above the wall (93).

Figure 10B:
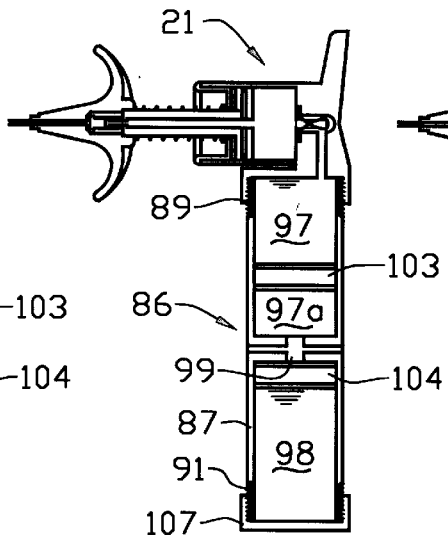
Figure 10C:
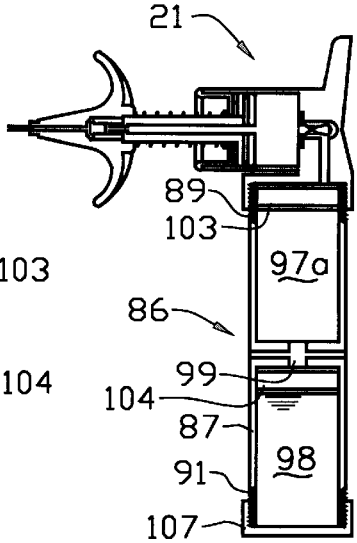
Figure 10D:
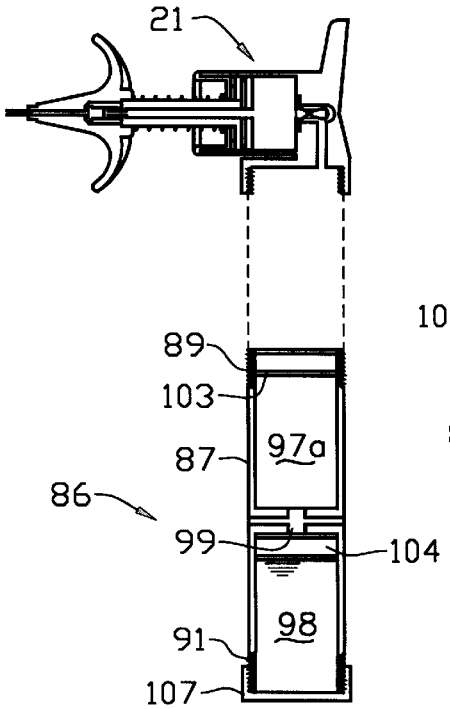
Figure 10E:
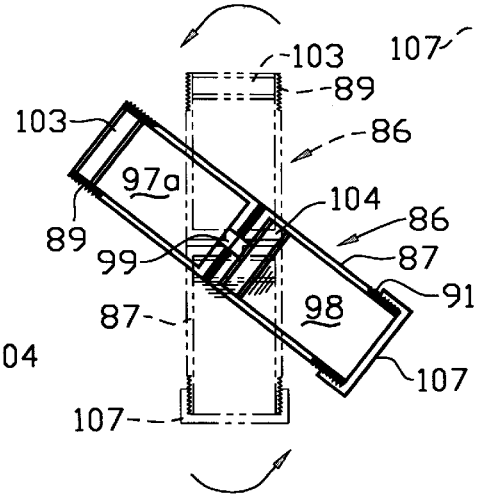
Figure 10F:
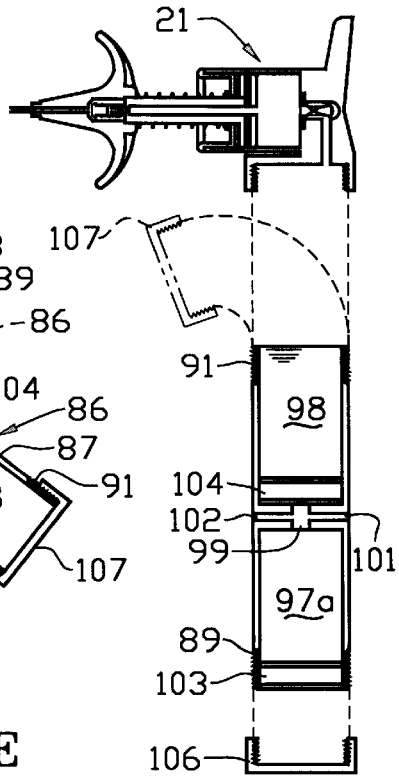

FIGS. 10A–10C illustrate this process, FIG. 10A showing the upper cap (106) having been removed and FIG. 10B showing the cartridge (86) upper end (89) sealingly, and threadably inserted into the receptacle (36). When all of the substance within the upper chamber (97) has been withdrawn by continued pumping action of the dispenser (21) such that the upper chamber (97) has been reduced to zero (97*a*) (FIG. 10C), the upper flat surface (108) of the upper piston (103) mating with the flat surface (77) of the receptacle (36) (See FIG. 9), the cartridge (86) can be removed from the receptacle (36), (FIG. 10D), rotated or reversed in position (FIG. 10E), the lower cap (107) removed and the upper cap (106) replaced on the now lower end (89) —or the lower cap (107) merely used now to replace the upper cap (106) (FIG. 10F), and the cartridge (86) reattached to the receptacle (36).

The contents of the former lower chamber (98) are available for use with the dispenser (21) in the same manner as the contents of the former upper chamber (97), the piston (104) (FIG. 10F) being at the bottom of the chamber (98) and in communication with the atmosphere via the opening (99) and ports (101), (102), such that pump-action of the trigger (43) effects withdrawal of the substance in chamber (98) and discharge of the dosage or quantity drawn into the body chamber (29) outwardly of the nose passage (48). As before, the now upper piston (104) moves upwardly against the substance, maintaining a positive pressure thereon until all of the substance has been withdrawn.

The dual chamber cartridge (86) can then be removed from the receptacle, both pistons (103), (104) moved back against the wall (93) such that both pistons (103), (104) are in their original positions as shown in FIG. 10A prior to rotation. As with the single chamber cartridge (22), continued refilling of the chambers (97), (98), re-attachment to the receptacle (36) and re-use of the cartridge (86) can be accomplished.

It may thus be seen that the objectives of this invention in providing a solution to the problems and disadvantages of the pump-type viscous dispensers of the prior art have been accomplished.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A dispenser unit for viscous substances comprising in combination:

a dispenser having a housing including an open, annular receptacle, a valved passage formed in said housing having opposed ends, one end open to the atmosphere and the opposite end open to said receptacle, and including further a member movable relative to said passage to effect a vacuum within said passage opposite end; and an annular, hollow cartridge open at opposite ends and having an annular piston sealingly and reciprocally inserted within said cartridge, a first end of said cartridge sealingly connected to said receptacle and forming a first chamber between said piston and said first end, and with said first chamber fillable with a viscous substance, said substance flowing out of said first chamber and into said passage in response to said vacuum, said piston movable toward said first end in response to evacuation of substance from said first chamber and forming a second chamber between said piston and said opposite end, said member movable additionally to discharge the substance from said passage one end, said cartridge removable from said receptacle, fillable with a viscous substance within said second chamber, said second end sealingly connected to said receptacle, whereby operation of said member effects a flow of substance through said passage from said second chamber followed by movement of said piston toward said second end.

2. The dispenser unit of claim 1, and further wherein said receptacle has an inner flat surface, and said piston has opposed flat faces, both said piston faces adapted to engage said receptacle flat surface.

3. The dispenser unit of claim 1, and further wherein said cartridge opposite ends are identical.

4. The dispenser unit of claim 3, and further wherein said receptacle has internal threads formed therein, and said cartridge opposite ends are each externally threaded for engagement with said receptacle threads.

5. The dispenser unit of claim 1, and wherein said cartridge is sufficiently rigid to withstand the vacuum created therein without collapsing.

6. The dispenser unit of claim 1, and further wherein said cartridge ends are foil sealed and with said piston adjacent said second end, and with said substance filled first chamber at maximum capacity.

7. The dispenser unit of claim 1, and further wherein a cap sealingly encloses said second end, and upon removement therefrom is capable of sealingly enclosing said first end.

8. For use with a dispenser having a housing including an open, annular receptacle, a valved passage formed in said housing having opposed ends, one end open to the atmosphere and the opposite end open to said receptacle, and including further a member movable relative to said passage to effect a vacuum within said passage opposite end:

an annular, hollow cartridge open at opposite ends and having an annular piston sealingly and reciprocally inserted within said cartridge, a first end of said cartridge sealingly connected to said receptacle and forming a first chamber between said piston and said first end, and with said first chamber fillable with a viscous substance, said substance flowing out of said first chamber and into said passage in response to said vacuum, said piston movable toward said first end in response to evacuation of substance from said first chamber and forming a second chamber between said piston and said opposite end, said member movable additionally to discharge the substance from said passage one end, said cartridge removable from said receptacle, fillable with a viscous substance within said second chamber, said second end sealingly connected to said receptacle, whereby operation of said member effects a flow of substance through said passage from said second chamber followed by movement of said piston toward said second end.

9. The cartridge of claim 8, and further wherein said receptacle has an inner flat surface, and said piston has opposed flat faces, both said piston faces adapted to engage said receptacle flat surface.

10. The cartridge of claim 8, and further wherein said cartridge opposite ends are identical.

11. The cartridge of claim 10, and further wherein said receptacle has internal threads formed therein, and said cartridge opposite ends are each externally threaded for engagement with said receptacle threads.

12. The cartridge of claim 8, and wherein said cartridge is sufficiently rigid to withstand the vacuum created therein without collapsing.

13. The cartridge of claim 8, and further wherein said cartridge ends are foil sealed and with said piston adjacent said second end, and with said substance filled first chamber at maximum capacity.

14. The cartridge of claim 8, and further wherein a cap sealingly encloses said second end, and upon removement therefrom is capable of sealingly enclosing said first end.

15. A dispenser unit for viscous substances comprising in combination:

a dispenser having a housing including an open, annular receptacle, a valved passage formed in said housing having opposed ends, one end open to the atmosphere and the opposite end open to said receptacle, and including further a member movable relative to said passage to effect a vacuum within said passage opposite end; and an annular hollow cartridge open at opposite first and second ends and having a wall at midpoint the length of said cartridge and forming a first and a second chamber within said cartridge on opposite sides of said wall, said wall having a first surface facing into said first chamber and a second, opposite surface facing into said second chamber, said wall having an axial opening formed therein and fluidly communicating said chambers, and having further a transverse port formed therethrough, the outer ends of said port opening to the atmosphere and the inner ends of said port fluidly communicating with said opening, a first annular piston sealingly and reciprocally mounted within said first chamber, and a second piston sealingly and reciprocally mounted within said second chamber, said cartridge first end sealingly connected to said receptacle with said first piston adjacent said wall first surface, a cap removably sealing said cartridge second end, with said second piston adjacent said wall second surface, said first chamber fillable with a viscous substance between said first piston and said first end, said second chamber fillable with a viscous substance between said second piston and said second end, said cartridge first end removable from said receptacle, said cap removed from said second end, and said second end sealingly connected with said receptacle, said cap optionally sealingly connected to said first end.

16. The dispenser unit of claim 15, and further wherein with said cartridge first end connected to said receptacle, said first piston has a surface adjacent said wall first surface, with said first piston surface exposed to atmospheric pressure via said port and said opening.

17. The dispenser unit of claim 15, and further wherein with said cartridge second end connected to said receptacle, said second piston has a surface adjacent said wall second surface, with said second piston surface exposed to atmospheric pressure via said port and said opening.

18. The dispenser unit of claim 17, and further wherein said receptacle has an inner flat surface, said wall first and second surfaces are flat, and said first and second pistons having opposed flat surfaces.

19. The dispenser unit of claim 18, and further wherein said cartridge opposite ends are identical.

20. The dispenser unit of claim 19, and further wherein said cartridge is sufficiently rigid to withstand the vacuum created therein without collapsing.

21. The dispenser unit of claim 20, and further wherein said cartridge ends are foil sealed.

22. For use with a dispenser having a housing including an open, annular receptacle, a valved passage formed in said housing having opposed ends, one end open to the atmosphere and the opposite end open to said receptacle, and including further a member movable relative to said passage to effect a vacuum within said passage opposite end:

an annular hollow cartridge open at opposite first and second ends and having a wall at midpoint the length of said cartridge and forming a first and a second chamber within said cartridge on opposite sides of said wall, said wall having a first surface facing into said first chamber and a second, opposite surface facing into said second chamber, said wall having an axial opening formed therein and fluidly communicating said chambers, and having further a transverse port formed therethrough, the outer ends of said port opening to the atmosphere and the inner ends of said port fluidly communicating with said opening, a first annular piston sealingly and reciprocally mounted within said first chamber, and a second piston sealingly and reciprocally mounted within said second chamber, said cartridge first end sealingly connected to said receptacle with said first piston adjacent said wall first surface, a cap removably sealing said cartridge second end, with said second piston adjacent said wall second surface, said first chamber fillable with a viscous substance between said first piston and said first end, said second chamber fillable with a viscous substance between said second piston and said second end, said cartridge first end removable from said receptacle, said cap removed from said second end, and said second end sealingly connected with said receptacle, said cap optionally sealingly connected to said first end.

23. The cartridge of claim 22, and further wherein with said cartridge first end connected to said receptacle, said first piston surface adjacent said wall is exposed to atmospheric pressure via said port and said opening.

24. The cartridge of claim 23, and further wherein with said cartridge second end connected to said receptacle, said second piston surface adjacent said wall is exposed to atmospheric pressure via said port and said opening.

25. The cartridge of claim 24, and further wherein said receptacle has an inner flat surface, said wall has opposed flat surfaces, and said first and second pistons having opposed flat surfaces.

26. The cartridge of claim 25, and further wherein said cartridge opposite ends are identical.

27. The cartridge of claim 26, and further wherein said cartridge is sufficiently rigid to withstand the vacuum created therein without collapsing.

28. The cartridge of claim 27, and further wherein said cartridge ends are foil sealed.

29. For use with a viscous substance dispenser having an annular, open receptacle, an annular hollow cartridge having identical opposite ends, both said ends respectively sealingly connectable to said receptacle, said cartridge filled with a viscous substance prior to usage, said cartridge having a piston sealingly and reciprocally mounted within said cartridge for movement axially from one said end to the other said end upon one said cartridge end connected to said receptacle, and said piston movable axially in an opposite direction from said other end to said one end upon said cartridge removed from said receptacle, reversed, and said opposite end connected to said receptacle.

30. For use with a viscous substance dispenser having an annular, open receptacle;

an annular hollow cartridge open at opposite first and second ends and having a wall at midpoint the length of said cartridge and forming a first and a second chamber within said cartridge on opposite sides of said wall, said wall having a first surface facing into said first chamber and a second, opposite surface facing into said second chamber, said wall having an axial opening formed therein and fluidly communicating said chambers, and having further a transverse port formed therethrough, the outer ends of said port opening to the atmosphere and the inner ends of said port fluidly communicating with said opening, a first annular piston sealingly and reciprocally mounted within said first chamber, and a second piston sealingly and reciprocally mounted within said second chamber, said cartridge first end sealingly connected to said receptacle with said first piston adjacent said wall first surface, a cap removably sealing said cartridge second end, with said second piston adjacent said wall second surface, said first chamber fillable with a viscous substance between said first piston and said first end, said second chamber fillable with a viscous substance between said second piston and said second end, said cartridge first end removable from said receptacle, said cap removed from said second end, and said second end sealingly connected with said receptacle, said cap optionally sealingly connected to said first end.

* * * * *